United States Patent [19]

Breznak et al.

[11] 4,048,277

[45] Sept. 13, 1977

[54] SPLICE FOR USE DURING THE THERMAL STABILIZATION OF A FLAT MULTIFILAMENT BAND OF AN ACRYLIC FIBROUS MATERIAL COMPRISING AT LEAST TWO SEGMENTS

[75] Inventors: Robert A. Breznak, Clifton; James A. Parker, Somerville, both of N.J.

[73] Assignee: Celanese Corporation, New York, N.Y.

[21] Appl. No.: 641,066

[22] Filed: Dec. 15, 1975

[51] Int. Cl.[2] ..... D06M 3/36

[52] U.S. Cl. ..... 264/83; 28/143; 28/164; 57/142; 57/159; 112/406; 112/412; 156/93; 156/157; 264/29.2; 264/103; 264/182; 264/206; 264/236; 264/347

[58] Field of Search ..... 264/340, 342 RE, 235, 264/236, 234, 257, 258, 345, 83, 103, 29.1, 29.2, 29.6–29.7, 182, 206; 156/93, 157; 28/77; 112/412, 441, 406; 428/57, 58, 61, 102; 57/142, 159; 68/2

[56] References Cited

U.S. PATENT DOCUMENTS

| | | | |
|---|---|---|---|
| 1,774,858 | 9/1930 | Vorbau | 428/61 |
| 3,155,062 | 11/1964 | Westmijze et al. | 28/77 |
| 3,206,344 | 9/1965 | Elkins, Jr. | 264/83 |
| 3,349,738 | 10/1967 | Kish, Jr. | 112/441 |
| 3,539,295 | 11/1970 | Ram | 423/447.6 |
| 3,546,330 | 12/1970 | Thompson | 264/258 |
| 3,754,957 | 8/1973 | Druin et al. | 264/345 |

*Primary Examiner*—Jeffery R. Thurlow

[57] ABSTRACT

An improved splice is provided which is useful in joining segments of a substantially flat band (e.g., a flat tow) of an acrylic fibrous material in an end to end relationship. A fabric surrounds and is sewn to an end of each band segment and extends beyond the end of the band to form a fabric extension. A pair of fabric extensions are sewn in an overlapping opposing relationship in the absence of any substantial overlap of the acrylic fibrous material of each band segment within the splice. The resulting splice is substantially flat in configuration and the band may be continuously passed in the direction of its length through the thermal stabilization zone without impairment of movement resulting from the presence of the splice. The usual exothermic heat of reaction which is evolved during the cyclization portion of the thermal stabilization reaction effectively is dissipated from within the splice without harm.

7 Claims, 5 Drawing Figures

SPLICE FOR USE DURING THE THERMAL STABILIZATION OF A FLAT MULTIFILAMENT BAND OF AN ACRYLIC FIBROUS MATERIAL COMPRISING AT LEAST TWO SEGMENTS

BACKGROUND OF THE INVENTION

It is well known that acrylic fibrous materials when subjected to heat undergo a thermal stabilization reaction wherein the fibrous material is transformed to a black form which is non-burning when subjected to an ordinary match flame.

Such modification generally has been accomplished by heating the acrylic fibrous material in an oxygen-containing atmosphere. It is believed that the resulting thermal stabilization reaction involves (1) an oxidative cross-linking reaction of adjoining molecules as well as (2) a cyclization reaction of pendant nitrile grounds to a condensed dihydropyridine structure. The cyclization reaction is exothermic in nature and must be controlled if the fibrous configuration of the acrylic polymer undergoing stabilization is to be preserved. The resulting thermally stabilized fibrous material is useful as a precursor in the formation of carbon fibers.

On a commercial scale the thermal stabilization reaction commonly is carried out on a continuous basis with a continuous length of a multifilament acrylic fibrous material being passed in the direction of its length through a thermal stabilization zone which is provided with a heated gaseous atmosphere. The movement of the continuous length of acrylic fibrous material through the stabilization zone may be directed by rollers, etc. situated therein.

When the continuous length of acrylic fibrous material is in the form of a flat band (e.g., a flat tow), a need has arisen for an improved flat splice which can be used to effectively join segments of the precursor so that the continuous operation of the thermal stabilization reaction will not have to shut down after the passage of each length of fibrous precursor through the furnace. For instance, acrylic tows are commercially available in the form of a bale having a finite filament length. Considerable down time commonly is involved to cool down the thermal stabilization zone, to string up another length of fibrous precursor, and to again bring the thermal stabilization zone to operating temperature. Such restringing also wastes a portion of the precursor fiber. Accordingly, those skilled in the art have been aware of the need for an effective splice technique whereby the thermal stabilization treatment may be conducted for an extended period of trouble free operation.

It has been found that the exothermic heat of reaction commonly creates difficulties in connection with prior splice attempts since the resulting heat is not effectively dissipated and may cause breakage of the fibrous band. Also, bulky splices (e.g., knots) commonly cannot be accommodated within thermal stabilization zones without interference and loss of process stability. If the band segments are laterally spread prior to conventional splicing in an overlapping fashion in an attempt to deal with the usual exothermic heat of reaction, then the substantially wider section of the band at the splice area complicates processing as the band travels on a continuous basis.

It is an object of the present invention to provide an improved process for the thermal stabilization of a substantially flat multifilament band of an acrylic fibrous material wherein the ends of at least two discrete band segments are joined and continuously are passed in a successive manner in the direction of their length through a heated thermal stabilization zone while maintaining the original fibrous configuration of the same substantially intact for a residence time sufficient to render the band black in appearance, and non-burning when subjected to an ordinary match flame.

It is an object of the present invention to provide a substantially falt multifilament band of an acrylic fibrous material which is capable of undergoing thermal stabilization by continuous passage through a thermal stabilization zone in the direction of its length having at least two discrete band segments which are joined in an end to end relationship by an improved splice.

It is an object of the present invention to provide a splice for joining in an end to end relationship at least two discrete band segments of an acrylic fibrous material wherein the exothermic heat of reaction resulting from a thermal stabilization reaction readily is dissipated.

It is a further object of the present invention to provide a splice for joining in an end to end relationship at least two discrete band segments of an acrylic fibrous material which is relatively flat in configuration and readily may be passed through a thermal stabilization zone without impairment of movement resulting from the presence of the splice.

These and other objects as well as the scope, nature, and utilization of the invention will be apparent from the following description and appended claims.

SUMMARY OF THE INVENTION

It has been found that in a process for the thermal stabilization of a substantially flat multifilament band of an acrylic fibrous material wherein the ends of at least two discrete band segments are joined and continuously are passed in a successive manner in the direction of their length through a heated thermal stabilization zone while maintaining the original fibrous configuration of the same substantially intact for a residence time sufficient to render the band black in appearance, and non-burning when subjected to an ordinary match flame; improved results are accomplished when the ends of at least two of said band segments are joined by (1) surrounding an end of each band segment with a fabric which is capable of withstanding the heated thermal stabilization zone with a portion of the fabric extending beyond each enclosed end of the band segment to form a substantially flat fabric extension, (2) sewing the fabric to each band segment in the area where the band is enclosed by the fabric with a thread which is capable of withstanding the heated thermal stabilization zone while maintaining the enclosed portion of the band in a substantially flat configuration, (3) overlapping a pair of the substantially flat fabric extensions with each of the band segments extending in an opposite direction, and (4) sewing together the overlapped substantially flat fabric extensions with a thread which is capable of withstanding the heated thermal stabilization zone to join the band segments of acrylic fibrous material in the absence of any substantial overlap of the acrylic fibrous material of each band segment.

The present invention provides a substantially flat multifilament band of an acrylic fibrous material which is capable of undergoing thermal stabilization by continuous passage through a thermal stabilization zone in the direction of its length having at least two discrete band segments which are joined in an end to end relationship by a splice comprising:

1. fabric capable of withstanding the thermal stabilization treatment which surrounds an end of each band segment and extends beyond the end of the band segment to form a substantially flat fabric extension, 2. stitches capable of withstanding the thermal stabilization treatment which join the fabric to the end of each band segment, and 3. stitches capable of withstanding the thermal stabilization treatment which unite a pair of the substantially flat fabric extensions while in an overlapping opposing relationship in the absence of any substantial overlap of the acrylic fibrous material of each band segment within the splice.

DESCRIPTION OF PREFERRED EMBODIMENTS

The band segments of multifilament acrylic fibrous material may be either an acrylonitrile homopolymer or an acrylonitrile copolymer which contains at least about 85 mole percent of acrylonitrile units and up to about 15 mole percent of one or more monovinyl units copolymerized therewith. Representative monovinyl units which may be incorporated in the acrylonitrile copolymers include styrene, methyl acrylate, methyl methacrylate, vinyl acetate, vinyl chloride, vinylidene chloride, vinyl pyridine, and the like.

The band segments of acrylic multifilament fibrous material may be formed in accordance with conventional solution spinning techniques (e.g., they may be formed by wet spinning or dry spinning). Preferably the acrylic fibrous material is hot drawn in accordance with known techniques to improve its physical properties, e.g. tenacity.

The size of the substantially flat multifilament band segments of acrylic fibrous material may be varied. For instance, the band segments may have a width of about 1 to 36 inches or more, and a relatively thin thickness of about 0.003 to 0.12 inch so that heat generated during the thermal stabilization reaction readily may be dissipated. The length of the band segments preferably is as long as possible and commonly corresponds to the lengths commercially available. For instance, acrylic bands can be purchased in bale form having lengths of up to about 10,000 feet, or more. The filaments forming the same may be crimped or uncrimped. The filaments of the band segments commonly possess an average denier per filament of about 1.5 to 3.5, or more. In a preferred embodiment of the invention the band segments utilized are flattened acrylic tows. Each band segment may consist of about 40,000 to 160,000, or more, continuous filaments. If desired, a plurality of parallel bands arranged in an edge-to-edge relationship may be joined to another band segment or plurality of band segments having the same overall width employing the splice of the present invention.

Stabilization promoting catalysts optionally may be incorporated within the acrylic fibers.

Figure 1:
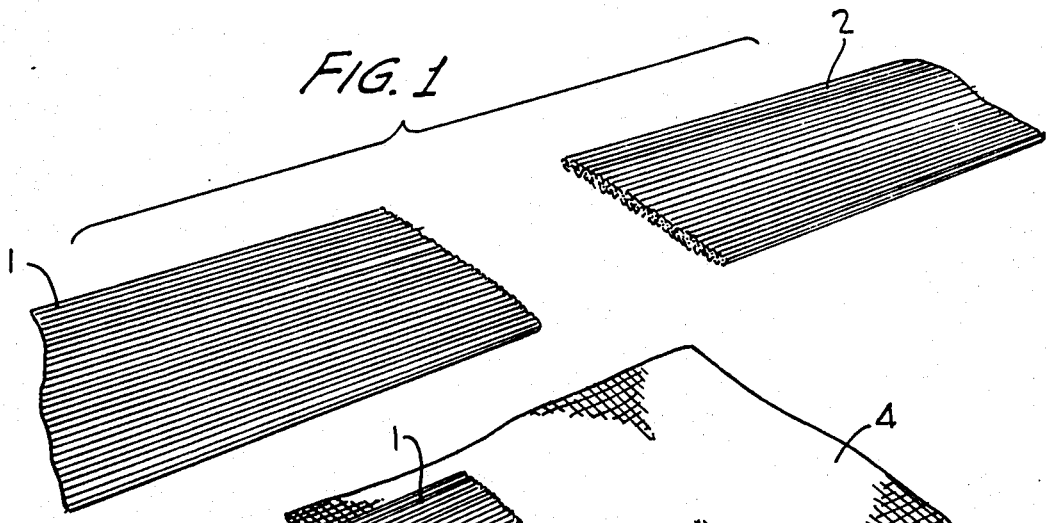
FIG. 1 is a perspective view of the ends of two discrete substantially flat multifilament band segments of an acrylic fibrous material which must be joined prior to being passed in a successive manner in the direction of their length through a thermal stabilization zone.

With reference to FIG. 1 the ends of two discrete substantially flat multifilament band segments 1 and 2 of an acrylic fibrous material of the same width are illustrated. Each band segment has a width of about 6 inches, a thickness of about 0.02 inch, and consists of about 160,000 continuous filaments having a denier per filament of about 3.0. For instance, one end may be the tail of a bale of acrylic fiber tow which is being fed to and passed through a thermal stabilization zone, and the other end may be derived from a like bale of the acrylic fiber tow which is awaiting stabilization. If the ends of the bands are not effectively spliced together it will be necessary to shut down the thermal stabilization zone, and introduce the second band segment. Such a procedure would be time consuming and economically unattractive.

Figure 2:
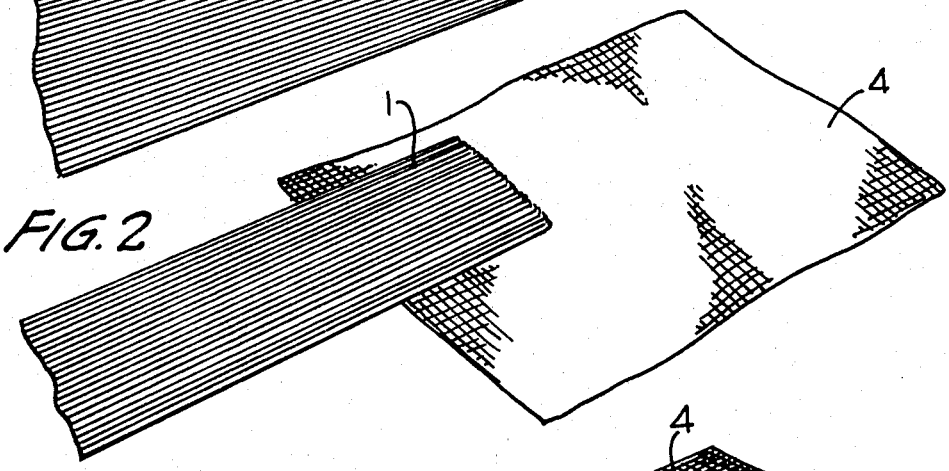
FIG. 2 is a perspective view of a single band segment of FIG. 1 with the end thereof placed upon a sheet of glass fabric prior to surrounding the end thereof with the glass fabric.

With reference to FIG. 2 the end of band segment 1 is placed upon a sheet of glass fabric 4 having a length of about 30 inches, and a width of about 12 inches. Alternatively the fabric may be formed from any other fibers which are capable of withstanding the thermal stabilization treatment, e.g. polytetrafluoroethylene, polybenzimidazole, etc. The fabric may possess a plain, satin, or other weave configuration. The size of the glass fabric will vary with the width of the band segments. It is preferred that the weave of the fabric be such that the exothermic heat of reaction generated during the thermal stabilization treatment be permitted to readily dissipate.

The fabric selected should preferably be drapeable, easily handled, possess a somewhat open construction, and have good strength in at least the direction of travel.

The following are representative glass fabrics which may be utilized in the splice of the present invention:

| Fabric No. | Construction Yarns Warp × Fil | Yarn Denier Warp × Fil | Tensile Strength Warp × Fil lbs./in. | Weave Pattern | Weight oz./yd.$^2$ |
|---|---|---|---|---|---|
| A | 57 × 54 | 600 × 600 | 375 × 335 | 8 sh. satin | 9.0 |
| B | 22 × 17 | 1800 × 1800 | 400 × 400 | plain | 8.7 |
| C | 42 × 32 | 600 × 600 | 250 × 200 | plain | 5.8 |
| D | 40 × 32 | 300 × 300 | 214 × 140 | plain | 2.85 |

Figure 3:
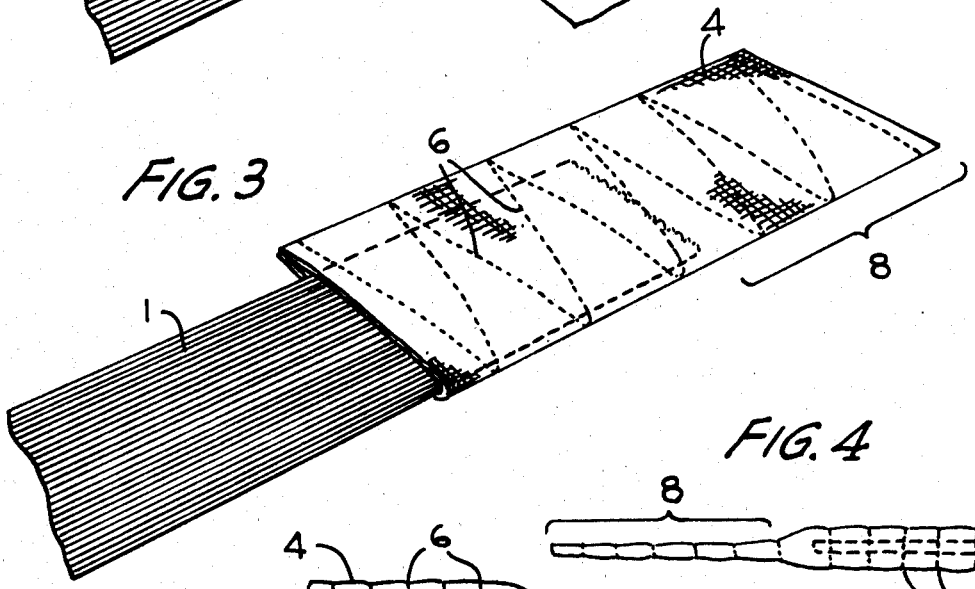
FIG. 3 is a perspective view of the band segment of FIG. 2 wherein the end thereof is surrounded by a glass fabric which extends beyond the enclosed end to form a flat fabric extension with stitches joining the glass fabric to the end of the band segment.

With reference to FIG. 3 the end of band segment 1 is surrounded by glass fabric 4, i.e., the glass fabric 4 is folded over the end of band segment 1 and encompasses both sides of the same. While surrounded by the glass fabric 4, the band segment 1 continues to exhibit a substantially flat configuration. A sewing machine is used to join the glass fabric to the end of band segment 1 with stitches. The stitches may be matched to the fabric to give a good seam as in any sewn article. The thread employed is capable of withstanding the heated thermal stabilization zone, e.g., the thread may be an acrylonitrile homopolymer, an acrylonitrile copolymer, polytetrafluorethylene, polybenzimidazole, glass, etc. A flat fabric extension 8 extends beyond the enclosed end of the band segment. A like fabric extension is secured to other band segments which are to be joined.

Figure 4:
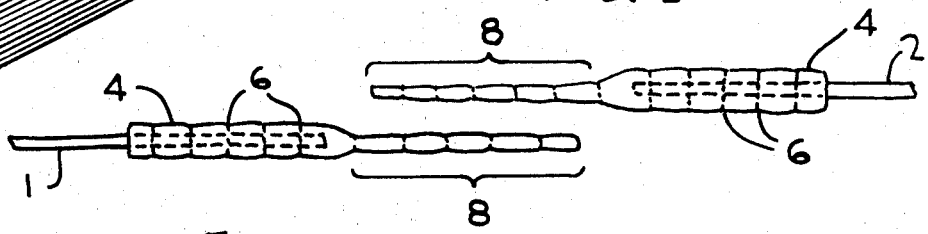
FIG. 4 is a side view of a pair of the band segments of FIG. 3 wherein the fabric extensions are overlapped with the band segments extending in opposite directions.

With reference to FIG. 4 a pair of the band segments 1 and 2 having like fabric extensions 8 are overlapped with the band segments extending in opposite directions. Stitches 6 join the glass fabric 4 to band segments 1 and 2.

Figure 5:
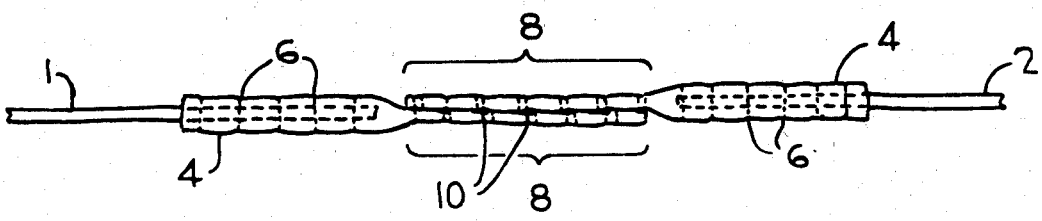
FIG. 5 is a side view of a pair of the band segments of FIG. 4 following the joining of the same by sewing together the overlapping fabric extensions in the absence of overlap of the acrylic fibrous material of each band segment within the resulting splice.

Finally with reference to FIG. 5 where like numbers designate the same components described with regard to FIG. 4, stitches 10 are utilized to sew together the overlapping fabric extensions 8 in the absence of overlap of the acrylic fibrous material of each band segment within the resulting splice. Stitches 10 may be formed using the same thread and equipment utilized initially to join the fabric to the band segments.

The resulting splice is flat in configuration and enables the band segments including the splice to be continuously passed through a heated thermal stabilization zone without hang-up or impairment of movement resulting from the presence of the splice. The usual exothermic heat of reaction which is evolved during the cyclization portion of the thermal stabilization reaction effectively is dissipated from within the splice without harm.

The thermal stabilization of the resulting band may be carried out in accordance with techniques known in the art. The substantially flat multifilament band may be continuously passed through the thermal stabilization zone in the direction of its length where it is rendered black in appearance and non-burning when subjected to an ordinary match flame. For instance, the movement of the band through the thermal stabilization zone may be made possible by passing the same over a multiplicity of rotating parallel rolls while the band is in a festooned relationship to each roll. The band may be looped about each parallel roll in a single wrap and is then passed to the next roll where it is looped in an identical manner. Since the rotating rolls have a cylindrical configuration and are in a parallel relationship, the controlled passage of the band undergoing stabilization is effectively maintained.

The number and length of any parallel rolls may be varied. The greater the number and separation of the rolls, the greater the residence time attainable at a given band speed. The greater the length of the parallel rolls, the greater the width of the band which may be stabilized. The rolls may engage a conventional drive mechanism wherein the rolls are caused to rotate in unison according to known techniques. If desired, the rolls may optionally idle, i.e., be rotated by the movement of the band looped thereon.

The band is contacted with a heated gaseous atmosphere present within the thermal stabilization zone until it attains a thermally stabilized form while retaining its original fibrous configuration essentially intact. The optimum treatment times and temperatures will vary depending upon the composition, denier per filament, and size of the multifilament band of acrylic fibrous material. Stabilization temperatures are selected which may be withstood by the band without destruction of its original fibrous configuration. The higher the temperature of the heated gaseous atmosphere generally the greater the rate at which the stabilization reaction occurs.

The gaseous atmosphere provided in the thermal stabilization zone preferably is oxygen-containing, and conveniently may be heated air. When the multifilament band is formed of conventional acrylonitrile homopolymer filaments of about 1.7 denier per filament, and the thermal stabilization zone is provided with a circulating air atmosphere at a temperature of about 260° C., the band commonly is thermally stabilized within about 60 to 180 minutes. When the multifilament band is formed of an acrylonitrile copolymer (i.e., Orlon acrylic tow) having a denier per filament of about 1.5, and the thermal stabilization zone is provided with circulating air at a temperature of about 250° C., the band commonly is thermally stabilized within about 60 to 240 minutes. Alternatively, the band of acrylic fibrous material may be thermally stabilized by heating in a stabilization zone which is provided at successively elevated temperatures as described in commonly assigned U.S. Pat. No. 3,539,295 of Michael J. Ram which is herein incorporated by reference.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. In a process for the thermal stabilization of a substantially flat multifilament band of an acrylic fibrous material wherein the ends of at least two discrete band segments are joined and continuously are passed in a successive manner in the direction of their length through a heated thermal stabilization zone while maintaining the original fibrous configuration of the same substantially intact for a residue time sufficient to render said band black in appearance, and non-burning when subjected to an ordinary match flame; the improvement comprising joining the ends of at least two of said band segments by (1) surrounding an end of each band segment with a fabric which is capable of withstanding the heated thermal stabilization zone having a weave configuration through which heat of reaction is permitted to dissipate with a portion of said fabric extending beyond each enclosed end of said band segment to form a substantially flat fabric extension, (2) sewing said fabric to each band segment in the area were said band is enclosed by said fabric with a thread which is capable of withstanding the heated thermal stabilization zone while maintaining the enclosed portion of said band in a substantially flat configuration, (3) overlapping a pair of said substantially flat fabric extensions in the absence of any substantial overlap of the acrylic fibrous material of each band segment with each of said band segments extending in an opposite direction, and (4) sewing together said overlapped substantially flat fabric extensions with a thread which is capable of withstanding the heated thermal stabilization zone to join said band segments of acrylic fibrous material in the absence of any substantial overlap of the acrylic fibrous material of each band segment.

2. An improved process according to claim 1 wherein said multifilament band of an acrylic fibrous material is selected from the group consisting essentially of an acrylonitrile homopolymer and acrylonitrile copolymers which contain at least about 85 mole percent of acrylonitrile units and up to about 15 mole percent of one or more monovinyl units copolymerized therewith.

3. An improved process according to claim 1 wherein said multifilament band of an acrylic fibrous material is a flattened tow.

4. An improved process according to claim 1 wherein said multifilament band has a width of about 1 to 36 inches.

5. An improved process according to claim 1 wherein said fabric which surrounds an end of each band segment which is capable of withstanding the heated thermal stabilization zone is a glass fabric.

6. An improved process according to claim 1 wherein said thread utilized in steps (2) and (4) is an acrylonitrile homopolymer.

7. An improved process according to claim 1 wherein said heated thermal stabilization zone is provided with an oxygen-containing atmosphere.

* * * * *